US005335392A

United States Patent [19]

Evans

[11] Patent Number: 5,335,392

[45] Date of Patent: Aug. 9, 1994

[54] TOOL FOR STRIPPING EXCESS PAINT FROM A PAINT ROLLER

[76] Inventor: Stuart Evans, 620 Haines Rd., Newmarket Ontario, Canada, L3Y 6V5

[21] Appl. No.: 114,828

[22] Filed: Sep. 2, 1993

[51] Int. Cl.[5] ..... A47L 13/022

[52] U.S. Cl. ..... 15/236.03; 15/236.07; 15/104.001

[58] Field of Search ..... 15/104.001, 236.03, 15/236.07; 30/169; 366/97, 98, 99, 342, 343; 134/900; D8/14, 45, 88, 89; D7/376, 377, 378; D32/35, 46, 47, 48, 49

[56] References Cited

U.S. PATENT DOCUMENTS

| | | | |
|---|---|---|---|
| D. 187,133 | 2/1960 | Walters | D8/14 |
| D. 330,101 | 10/1992 | Weiss | D32/35 |
| 209,957 | 11/1878 | Castle | D32/35 |
| 978,372 | 12/1910 | Hayne | 366/98 |
| 1,144,749 | 6/1915 | Beck | 366/343 |
| 1,579,495 | 4/1926 | Stroud | 30/169 |
| 2,297,566 | 9/1942 | Laux | 15/236.07 |
| 2,761,165 | 9/1956 | Krzanowski | 15/236.03 |
| 2,905,453 | 9/1959 | Wise | 366/343 |
| 4,287,631 | 9/1981 | Marrs | 15/236.03 |
| 4,546,831 | 10/1985 | Albertson | D8/14 |

FOREIGN PATENT DOCUMENTS

| | | | |
|---|---|---|---|
| 183396 | 7/1922 | United Kingdom | 30/169 |
| 0749275 | 5/1956 | United Kingdom | 115/236.03 |

*Primary Examiner*—Timothy F. Simone
*Assistant Examiner*—Randall E. Chin
*Attorney, Agent, or Firm*—Jane Parsons

[57] ABSTRACT

A tool for stripping excess paint from a paint roller is an arcuate hook having the radius of the paint roller. The hook is set on a handle at an angle for the user to use the hook against the paint roller to strip paint out of it in longitudinal strokes. Preferably the arc is a semi-circle.

9 Claims, 6 Drawing Sheets

TOOL FOR STRIPPING EXCESS PAINT FROM A PAINT ROLLER

BACKGROUND OF THE INVENTION

1. Field of the Invention

This invention relates to a tool for aiding stripping of excess paint from paint rollers at the end of a use session.

2. Description of the prior art

Paint rollers for applying paint to surfaces such as walls and ceilings comprise an elongate cylinder covered with paint absorbent material such as felt, open cell foam, or piled surface. The paint roller is dipped into paint and rolled across the surface of the wall to distribute the paint over it. Many paints used with paint rollers are of the latex type which may be cleaned off the paint applying utensil using water. Paint rollers are, however, notoriously difficult to clean. As water or other cleaning fluid is applied to the surface of the absorbent paint roller cylinder it tends to distribute itself around the cylinder to further distribute excess paint. It is difficult to remove surplus paint prior to washing.

If a straight blade is used to scrape or squeeze the roller in a longitudinal direction an appreciable amount of the displaced paint is displaced around the circumference of the roller also. If the roller is then rotated to bring a different portion of its surface into position for scraping, the next scraping action will partially distribute paint contaminated liquid back into the already scraped portion.

Various tools have been used for scraping paint rollers. These usually comprise straight blades with plain or serated edges.

Generally whatever the tool used for stripping excess paint from the paint roller there is always an appreciable amount of paint left in the spongy or other absorbent surface of the roller.

Such is the inefficiency of available tools which may be used for cleaning paint rollers (whatever their intended purpose), some painters find the most efficient way of stripping the roller is to curve their hand around the paint roller and manually wash it. This system has clear disadvantages to the painter in cleanliness of operation, care of his hands and general convenience.

In any event, the use of a large amount of cleaning liquid seems to be necessary.

SUMMARY OF THE INVENTION

The present inventor has addressed the problem of providing an efficient paint roller stripping tool. According to the invention there is provided a tool for stripping a paint roller of specific radius, the tool comprising an elongate handle having a peripheral surface having a major and minor axis whereby the peripheral surface is suitable for manual grip by a single hand in at least one specific orientation; a shaft extending from one end of the handle, the shaft initially extending from the handle parallel to a longitudinal axis of the handle and then veering three dimensionally to end in a distal arcuate hook with a radius generally similar to the specific radius of the paint roller, the arcuate hook lying in a plane at an acute angle to a plane containing said major axis of the peripheral surface of the handle, and a chord of arc of the arcuate hook taken from the free end of the hook lying at an angle to the longitudinal axis of the handle. By "veerying three dimensionally" is meant that the shaft bends to alter its initial orientation to both the plane containing the major axis of the handle and the minor axis of the handle.

Usually the shaft initially extends from the handle coaxially with the longitudinal axis of the handle. The acute angle between the plane in which the arcuate hook lies and the plane containing the major axis may range from 45 degrees to 25 degrees but may suitably be substantially 30 degrees. The angle between said chord of arc and the longitudinal axis of the handle may be about 45 degrees. Suitably the hook may be substantially semicircular.

The hook may be formed from any suitable materials. One important consideration is that the hook should be sufficiently strong to scrape the surface of the roller to squeeze paint out of the absorbent surface without breakage. The hook and shaft may be, for example, a carbon steel rod having a diameter of about 5 mm.

Another important consideration concerns the handle design. The handle should be so shaped that it is naturally positioned in the hand so that the hook is easily used to scrape the paint roller. Thus, the whole tool may be moulded from rigid plastics material.

BRIEF DESCRIPTION OF THE DRAWINGS

An embodiment of the invention will now be described by way of example with reference to the drawings, in which.

DETAILED DESCRIPTION OF A PREFERRED EMBODIMENT

Figure 1:
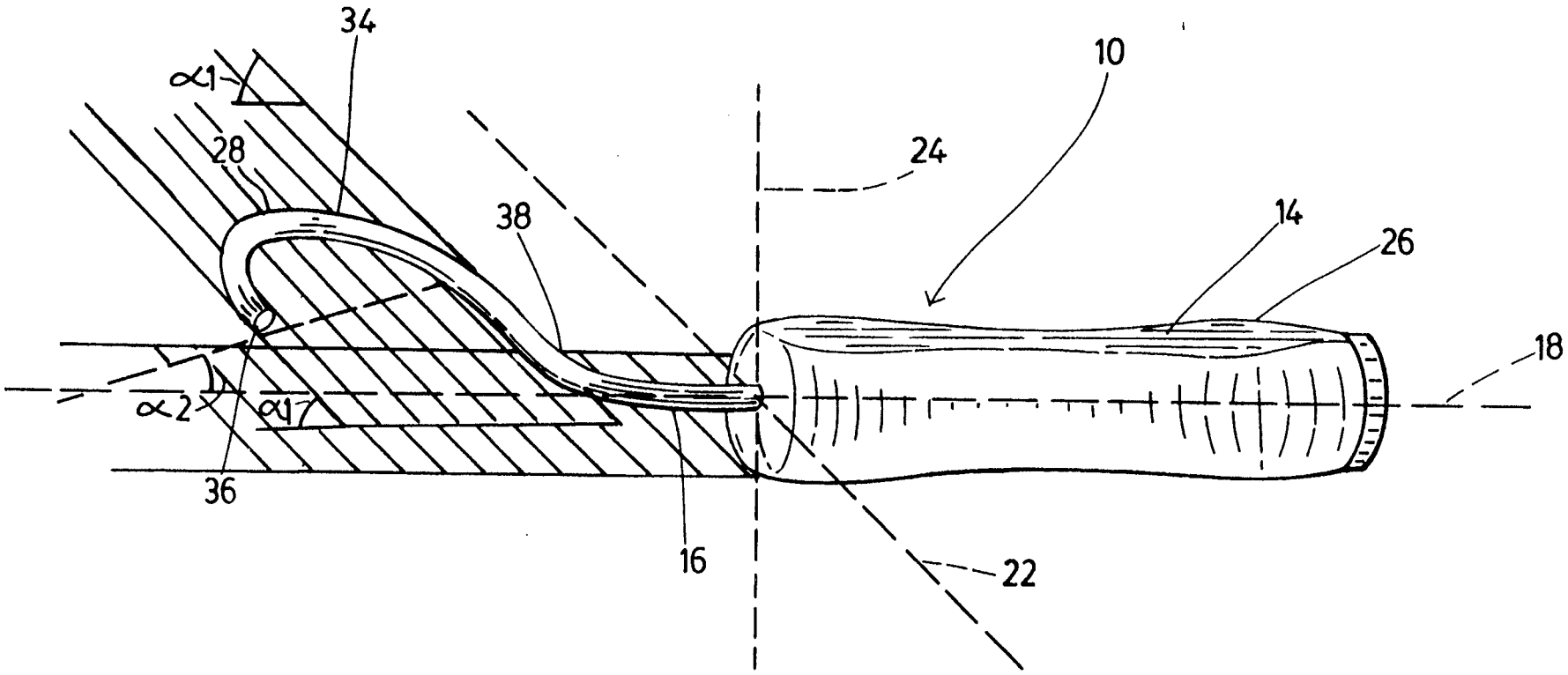
FIG. 1 is a view of a paint roller stripping tool according to the invention.
Figure 2:
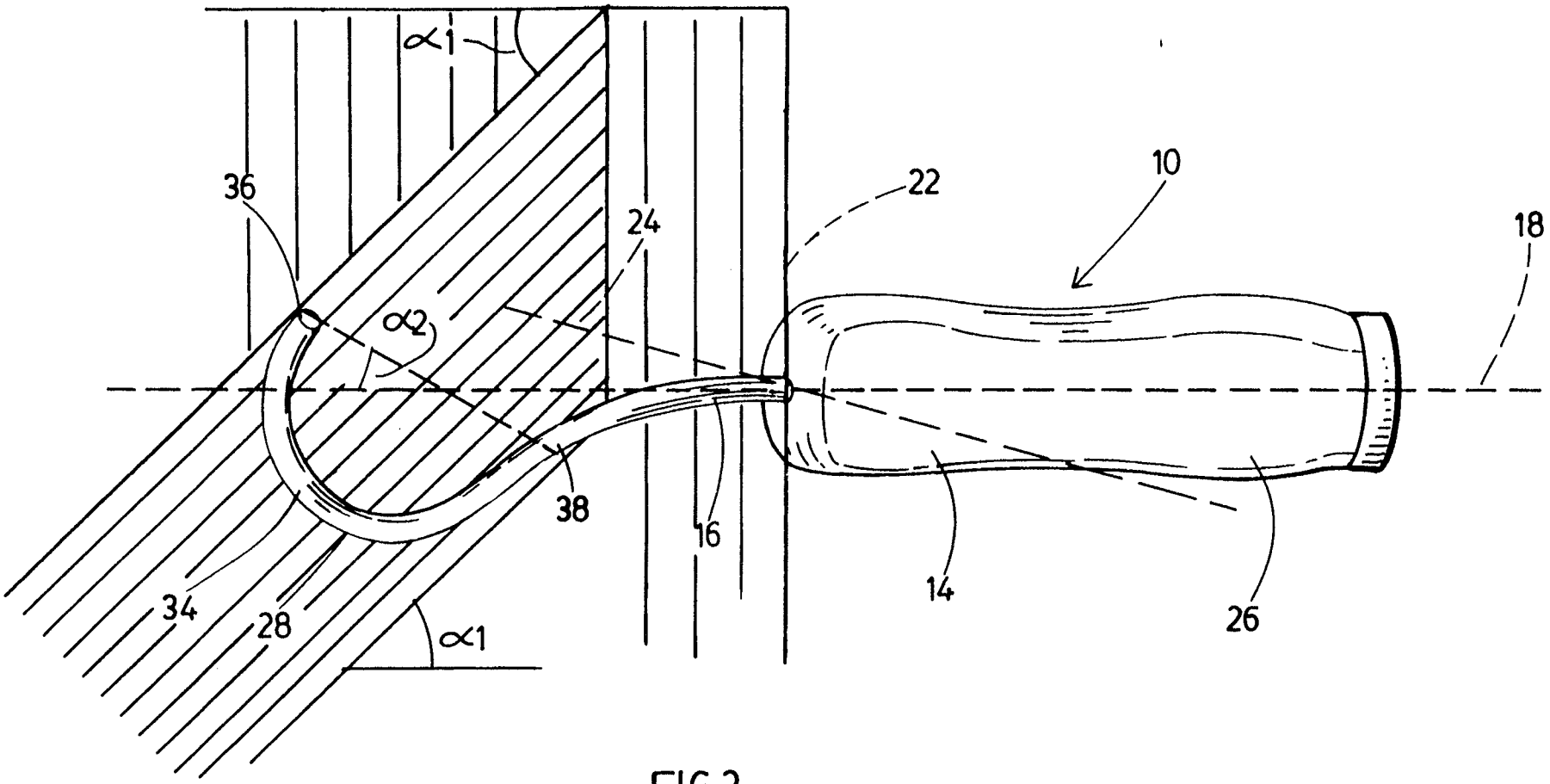
FIG. 2 is a view of the paint roller stripping tool of FIG. 1 as seen from a different angle.

A tool 10 for stripping a paint roller 12 is shown in the drawings. Tool 10 comprises an elongate handle 14 and a shaft 16 which extends initially substantially coaxially with the longitudinal axis 18 of the handle 14. The tool 10 may be moulded from plastics material or may be of any suitable material. A heavy duty tool may suitably have a wooden handle of a comfortable fit to the hand 20 and a carbon steel shaft of a diameter of around 5 mm. Lighter duty tools may be of a lighter construction or may be moulded from plastic material.

The handle 14 of tool 10 is shaped so as to fit into the hand 20 of an operator in a specific orientation. Thus the handle 14 has a peripheral surface which has a cross section having a major axis 22 and a minor axis 24 both perpendicular to its longitudinal axis 18. The actual shape of the handle 14 is such that it is slightly wider than it is deep so that it is natural to grasp it with the narrower contour against the palm of the hand and the wider contour resting against the base of the fingers. Additional contouring can be provided such as the slightly thickened end portion 26 which provides additional hand comfort. The reason for desiring the handle to fit into the hand in a particular orientation is to present the tool 10 to the paint roller 12 at a convenient comfortable angle. The shaft 16 bends away from its initial direction coaxial with the longitudinal axis 18 and forms, at its distal end, a hook 28 adapted to scrape the surface of the paint roller 12. The hook 28 is an arcuate loop having a radius similar to the radius of the paint roller 12. Suitably, as shown, the hook may be of generally semicircular form.

For ease of operation, the hook 28 is located such that its plane will be easily angled to the paint roller during operation. For example, the shaft 16 veers away from its initial direction to bend three dimensionally with respect to the longitudinal axis 18 of handle 14. The plane in which the hook 28 lies at an acute angle $\alpha_1$ to the plane containing the major axis 22 of handle 14, Moreover, a chord of the arc of the hook 28 lies at an angle $\alpha_2$ to the longitudinal axis of the handle 14. The angle $\alpha_1$ may generally be in the range from about 25° to about 45° but may often be about 30°. The angle $\alpha_2$ may generally be about 45°, i.e. the shaft 16 has veered away from the longitudinal axis by 45 degrees.

The provision of a hook 28 orientated in the above described manner may facilitate stripping of paint from the roller 12 as will now be described.

The user grasps the handle 14 of the tool 10 such that one narrow side of the handle 14 fits closely against the user's palm and the base of his fingers lie against the wider dimension, and the top of his fingers wrap over the other narrow side. While it is appreciated that other forms of shaping may be utilized to ensure that a user grasps the tool in a particular orientation, the simple expedient of providing a handle having major and minor axes 22,24 provides the simplicity of manufacture and resultant economy of cost.

Figure 3:
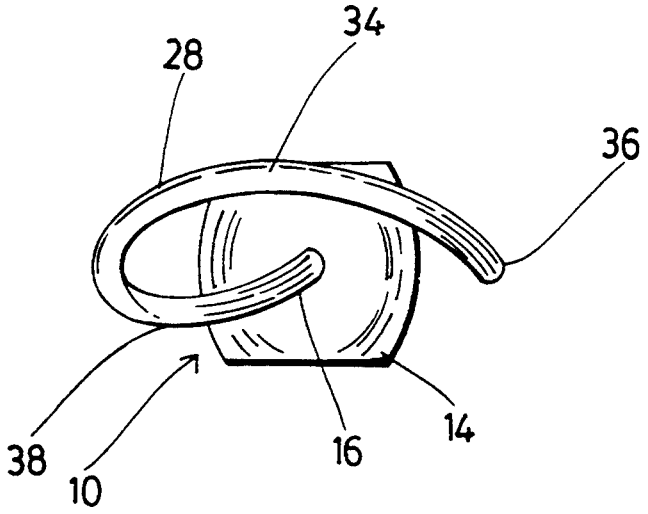
FIG. 3 is a view of the paint roller from the hook end.

When the user has grasped the tool 10 in his hand 20, he make take a dirty paint roller 12 in his other hand 40. The paint roller should be held with the roller portion 32 directed downwardly against a support surface 33 as, for example, shown in FIGS. 3 and 4. The hook 28 may be located with its deepest part 34 resting against the surface of the paint roller 12 near its top end and its whole length in contact with the surface of the paint roller (see FIG. 3) to remove a wide strip of paint. It is not, however, necessary that the free end of the hook 36 or the proximal end 38 of the hook initially in contact with the paint roller. By twisting the roller into a different orientation (see FIG. 4) a selectively narrower strip may be removed if desired. Normally, however, the whole length of the hook will be used as shown in FIG. 3. The orientation of the plane of the hook 28 with respect to the handle 14 and hence with respect to the hand 20 are convenient to allow the user easily to orientate the hook against the roller 12.

The hook 28 may then be drawn down the surface of the paint roller while exerting pressure to squeeze out surplus paint in a strip 29 corresponding to the length of the hook which is in contact with the paint roller. This process may be repeated in elongate strips around the surface of the paint roller. As more and more paint is removed from the paint roller the surface of the paint roller should become more resilient.

Figure 4:
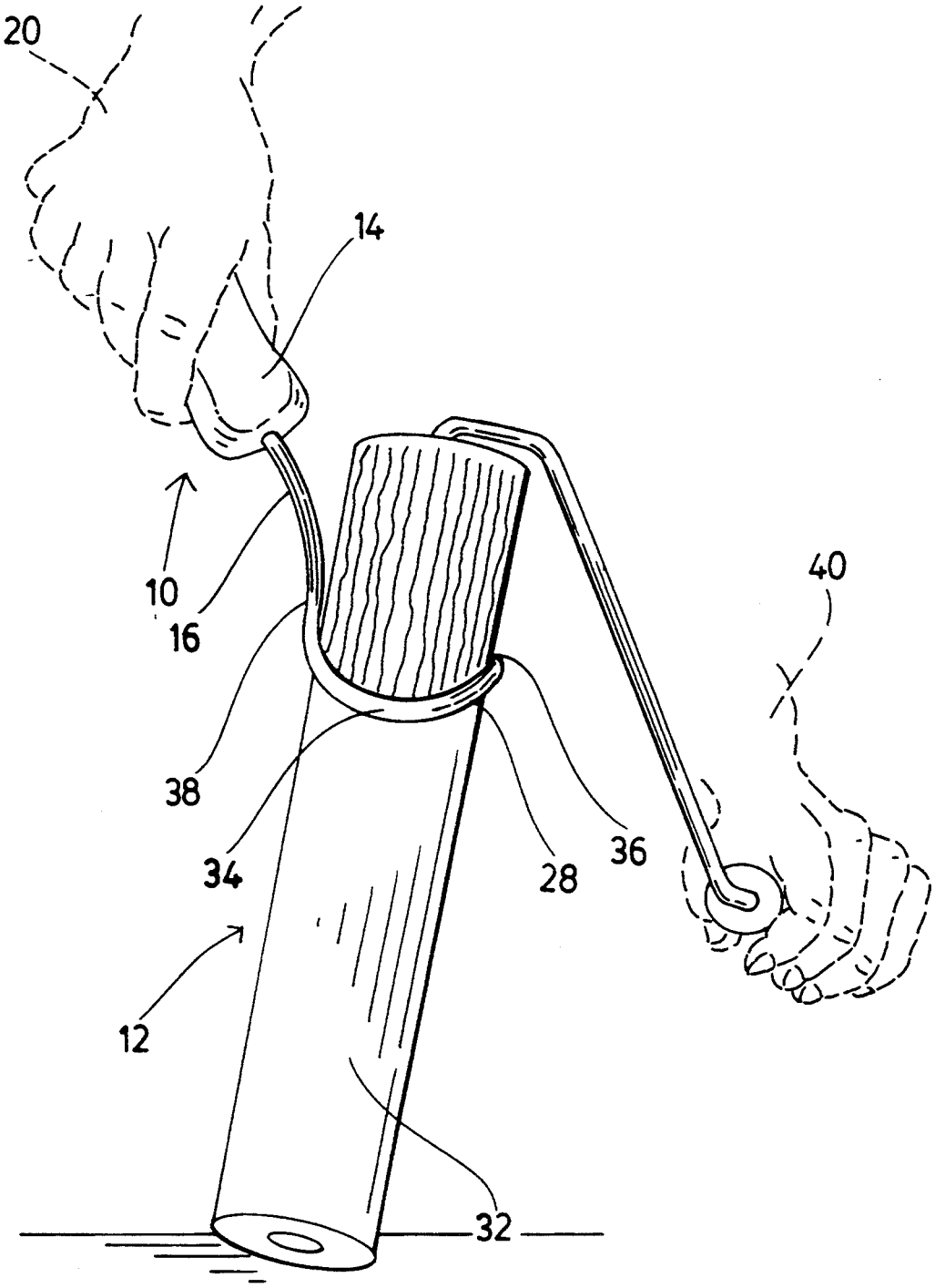
FIG. 4 shows one method of use of the paint roller stripping tool of FIGS. 1 and 2 to removing a broad strip of paint.
Figure 5:
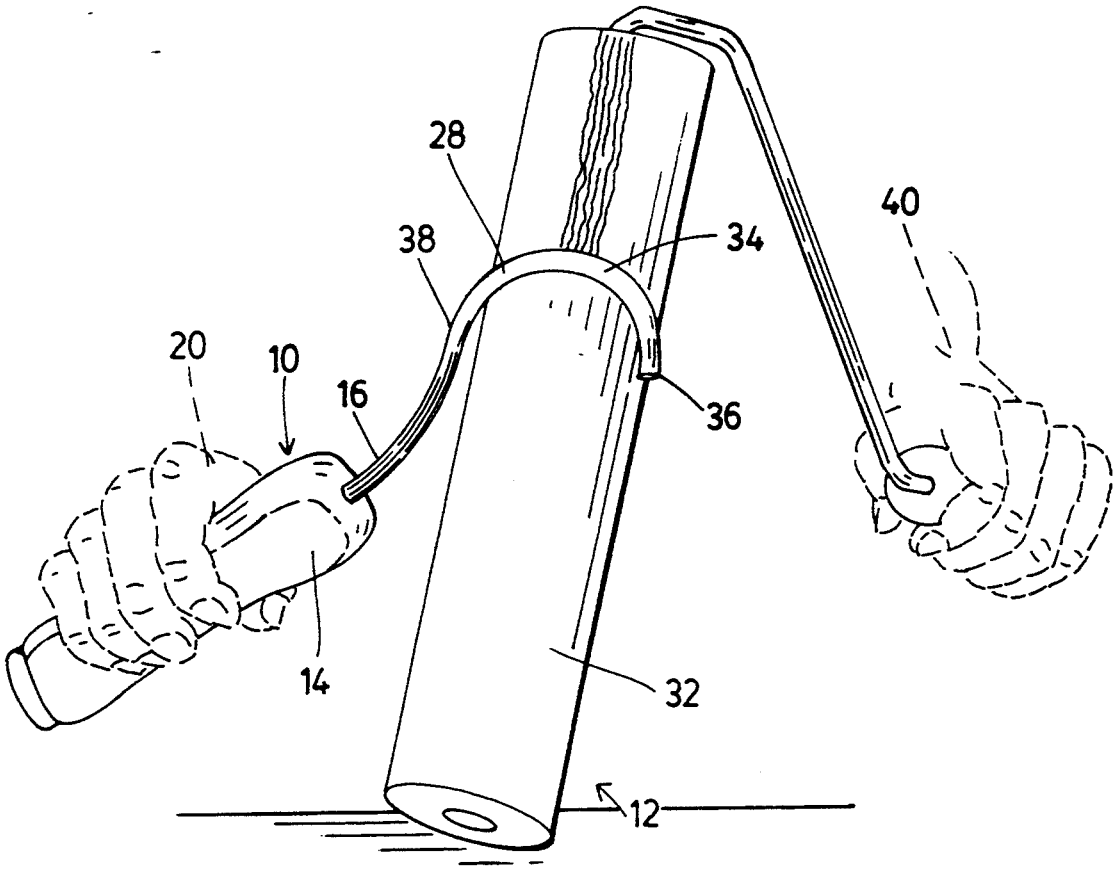
FIG. 5 shows the method of use of the paint roller stripping tool removing a narrow strip of paint.
Figure 6:
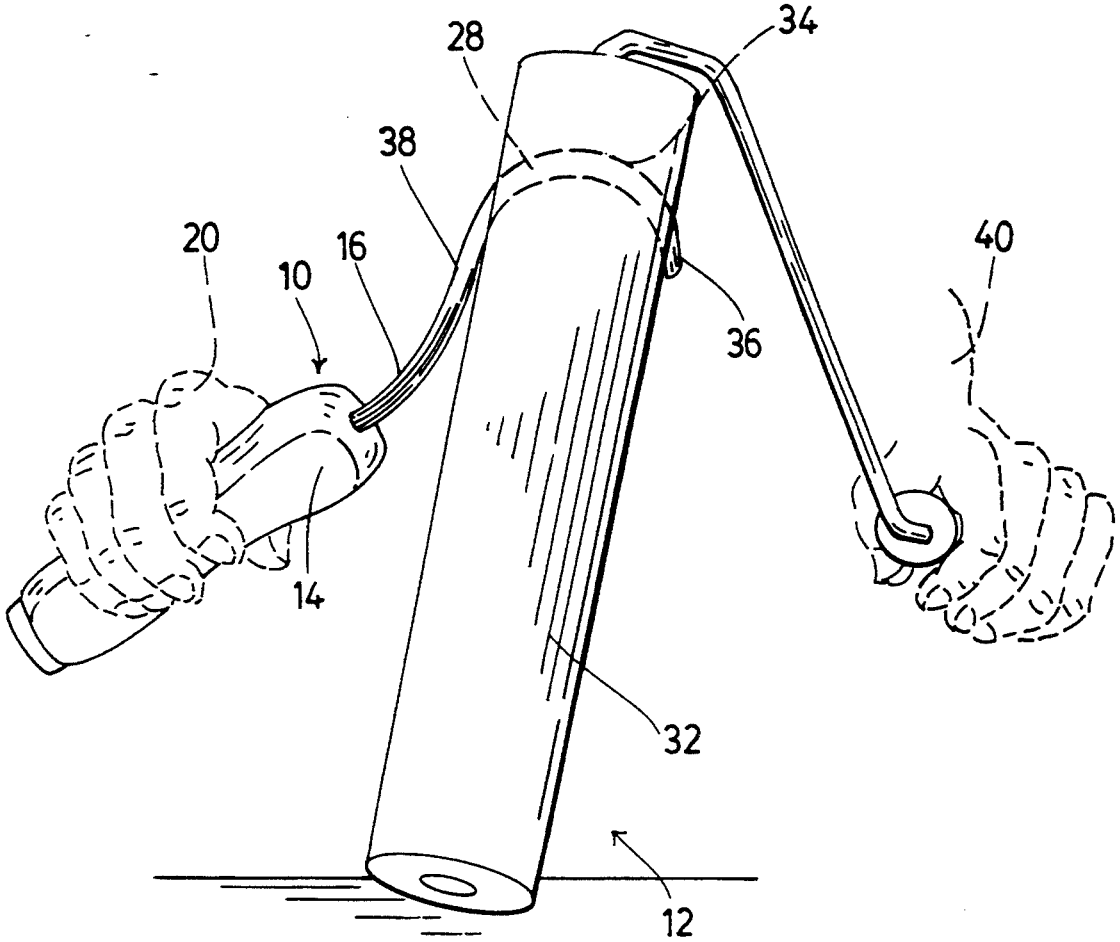
FIG. 6 shows another method of use of the paint roller stripping tool of FIG. 1 and 2.

FIG. 5 shows another way of using the tool 10. FIG. 3 shows the hand 20 grasping the handle 14 of the tool 10 with the hook orientated downwardly on a forward side of the paint roller. In this position the hook may be pushed over the surface of the roller. FIG. 4 shows the hand 20 grasping the handle 14 with the hook 28 orientated upwardly on a rearward side of the paint roller. The width of the strip of paint removed may be adjusted by orientation of the hook on the rearward surface of the paint roller in a similar manner to that already described. In fact, in practice it is quite likely that the user will alternate strokes from in the FIG. 3 position and in the FIG. 5 position.

I claim:

1. A tool for stripping excess paint from a paint roller of designated radius, the tool comprising, an elongate handle having a peripheral surface and a longitudinal axis and having a major and a minor axis perpendicular to the longitudinal axis whereby the thickness of the handle is greater over the major axis than it is over the minor axis so that the peripheral surface is suitable for manual grip by a single hand in at least one specific orientation;

a shaft extending from one end of the handle, the shaft initially extending from the handle parallel to the longitudinal axis of the handle and then three dimensionally veering away from the longitudinal axis and ending in a distal arcuate hook of a radius to fit about an arc of the paint roller, the arcuate hook lying in a plane at an acute angle to a plane containing said major axis of the peripheral surface of the handle, and a chord of the arc of the hook taken from the free end of the hook lying at an angle to the longitudinal axis of the handle.

2. A tool as claimed in claim 1 in which the shaft initially extends from the handle coaxially with the longitudinal axis of the handle.

3. A tool as claimed in claim 1 in which the acute angle between the hook plane and the plane containing the major axis ranges from 45° to 25°.

4. A tool as claimed in claim 3 in which the said acute angle is substantially 30°.

5. A tool as claimed in claim 1 in which the angle between said chord of arc and the longitudinal axis of the handle is about 45°.

6. A tool as claimed in claim 1 in which the hook is substantially semicircular.

7. A tool as claimed in claim 1 in which the shaft is a carbon steel rod having a diameter of about 5 mm.

8. A tool as claimed in claim 1 in which the handle and the hook are moulded from rigid plastics material.

9. In combination with a paint roller having a roller of designated radius and a tool for stripping excess paint from said paint roller, the tool comprising, an elongate handle having a peripheral surface and a longitudinal axis and having a major and a minor axis perpendicular to the longitudinal axis whereby the peripheral surface is suitable for manual grip by a single hand in at least one specific orientation;

a shaft extending from one end of the handle, the shaft initially extending from the handle and then three dimensionally veering away from the longitudinal axis and ending in a distal arcuate hook of a radius similar to the specific radius to fit about an arc of the paint roller, the arcuate hook lying in a plane at an acute angle to a plane containing said major axis of the peripheral surface of the handle, and a chord of the arc of the hook arc of the arcuate hook taken from the free end of the hook lying at an angle to the longitudinal axis of the handle.

* * * * *